US006978616B1

(12) United States Patent
Schauer

(10) Patent No.: US 6,978,616 B1
(45) Date of Patent: Dec. 27, 2005

(54) HYBRID PISTON-PULSED DETONATION ENGINE

(75) Inventor: Frederick R. Schauer, Dayton, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 122 days.

(21) Appl. No.: 10/706,192

(22) Filed: Nov. 12, 2003

Related U.S. Application Data

(60) Provisional application No. 60/426,669, filed on Nov. 12, 2002.

(51) Int. Cl.[7] ..... F01B 21/04

(52) U.S. Cl. ..... 60/698; 60/643

(58) Field of Search ..... 60/643, 698

(56) References Cited

U.S. PATENT DOCUMENTS

| | | | | |
|---|---|---|---|---|
| 2,319,773 | A * | 5/1943 | Ericson | 123/577 |
| 2,695,011 | A * | 11/1954 | Dodds et al. | 123/1 A |
| 5,615,548 | A * | 4/1997 | Winfree et al. | 60/39.78 |
| 6,505,462 | B2 * | 1/2003 | Meholic | 60/39.39 |

* cited by examiner

*Primary Examiner*—Hoang Nguyen
(74) *Attorney, Agent, or Firm*—AFMCLO/JAZ; Fredric L. Sinder; Bobby D. Scearce

(57) ABSTRACT

A hybrid piston engine-pulsed detonation engine structure is provided for obtaining shaft power from a pulsed detonation engine wherein a piston engine operatively connected to a PDE. A deflagration to detonation transition is used to achieve detonations. The piston engine has a piston that is located in the deflagration region of the deflagration to detonation transition. The hybrid engine has a critical starting frequency, above which the engine will self-actuate and produce excess power.

20 Claims, 4 Drawing Sheets

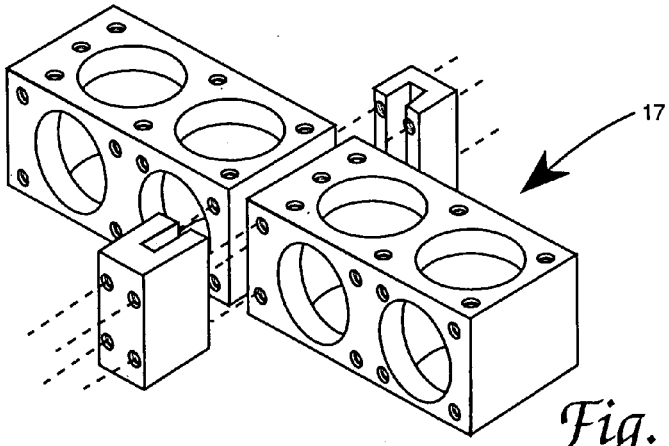
Fig. 3
Fig. 5
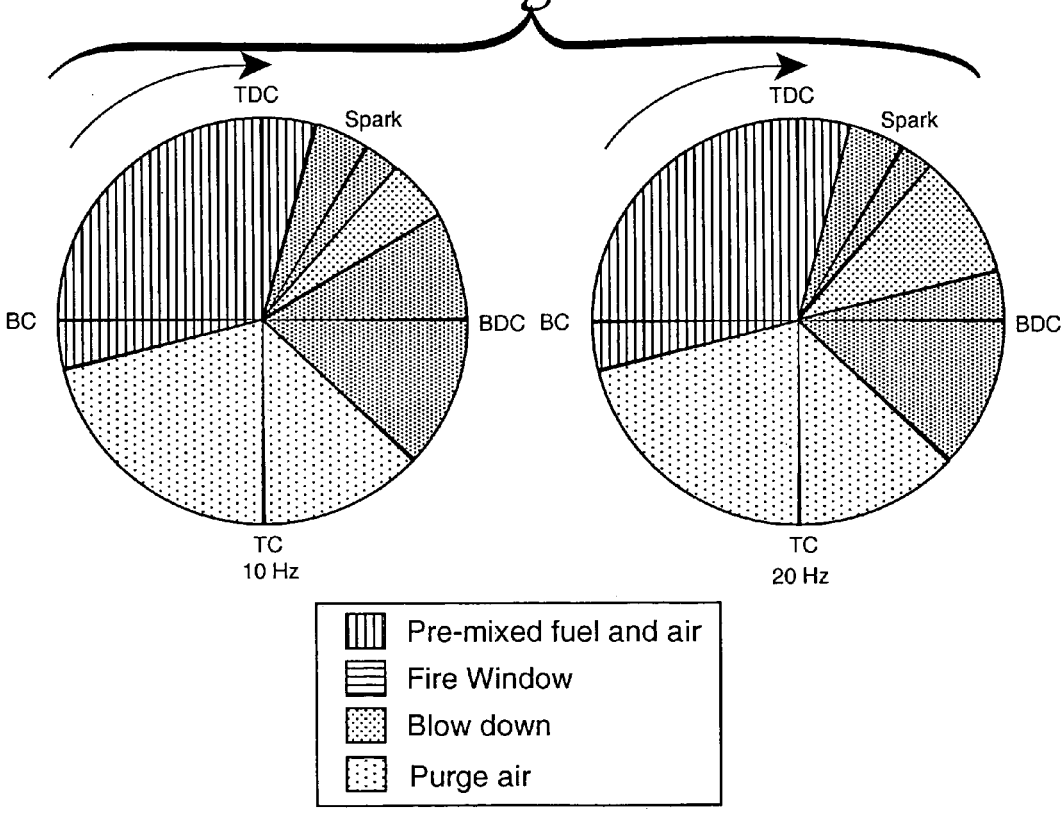

HYBRID PISTON-PULSED DETONATION ENGINE

CROSS-REFERENCE TO RELATED APPLICATION

This application claims priority of the filing date of Provisional Application Ser. No. 60/426,669 filed 12 Nov. 2002, the entire contents of which are incorporated by reference herein.

RIGHTS OF THE GOVERNMENT

The invention described herein may be manufactured and used by or for the Government of the United States for all governmental purposes without the payment of any royalty.

BACKGROUND OF INVENTION

The present invention relates generally to pulsed detonation engines, and more particularly to a pulsed engine structure that provides shaft power.

In recent years, there has been a resurgence of interest and research directed toward pulsed detonation engines (PDE). Recent advances in computers and diagnostic tools have allowed researchers to overcome many of the technology hurdles hindering the construction of a practical PDE. Depending on the application, these obstacles include detonation initiation, valving or flow control, aspiration, power extraction and others. Traditionally, the PDE has been viewed as a thrust-producing engine, however, for the PDE to perform satisfactorily in most commercial applications, such as in commercial passenger jet airliners, a second engine for power extraction from the PDE would be required to run subsystems such as lights and air conditioning. A need exists in the art for a PDE that can generate both thrust power and shaft power.

It is therefore a principal object of the invention to provide an improved PDE.

It is another object of the invention to provide a PDE providing shaft power.

It is another object of the invention provide a modified piston engine-PDE providing both thrust and shaft power.

These and other objects of the invention will become apparent as a detailed description of representative embodiments proceeds.

SUMMARY OF THE INVENTION

In accordance with the foregoing principles and objects of the invention, a hybrid piston engine-pulsed detonation engine structure is provided for obtaining shaft power from a pulsed detonation engine wherein a piston engine operatively connected to a PDE. A deflagration to detonation transition is used to achieve detonations. The piston engine has a piston that is located in the deflagration region of the deflagration to detonation transition. The hybrid engine has a critical starting frequency, above which the engine will self-actuate and produce excess power.

DESCRIPTION OF THE DRAWINGS

The invention will be more clearly understood from the following detailed description of representative embodiments thereof read in conjunction with the accompanying drawings wherein:

FIG. 3 is a view in perspective of a spacer block of the hybrid engine of FIGS. 1 and 2;

FIG. 5 is a graphical representation of engine timing and pressure during a cycle at two different frequencies for the engine of the invention;

DETAILED DESCRIPTION

Experiments conducted on a hybrid piston-pulsed detonation engine to evaluate the power extraction characteristics may be found in the Provisional Application referenced above at the appendix entitled "*Evaluation of a Hybrid Piston-Pulsed Detonation Engine*," AIAA 2002-0074, $40^{th}$ Aerospace Sciences Meeting and Exhibit, Reno, Nev. (14–17 Jan. 2002).

Figure 1:
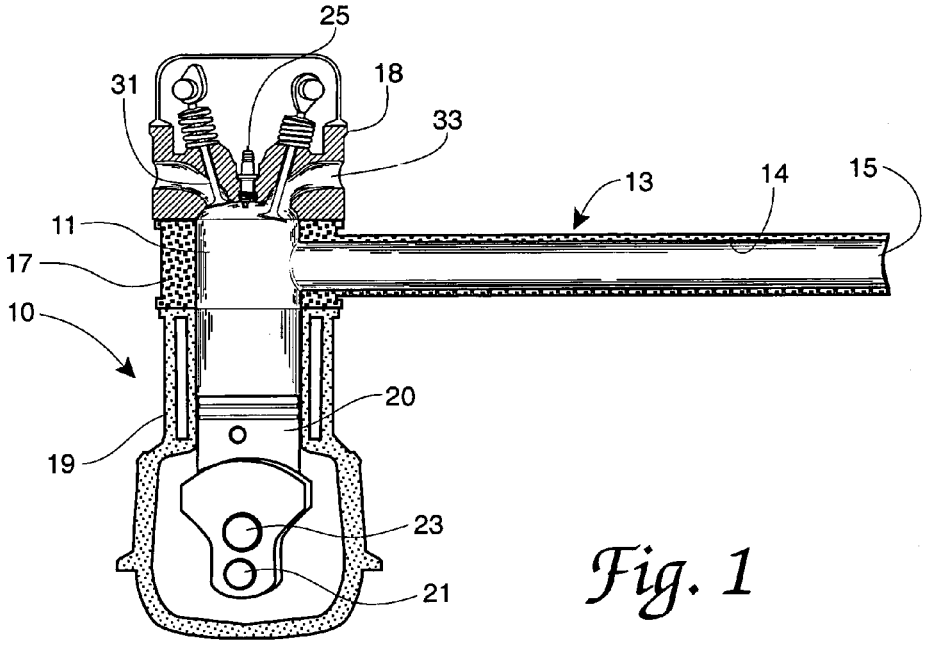
FIG. 1 is a cross sectional view of a representative embodiment of the hybrid piston-PDE of the invention.

Referring now to the drawings, FIG. 1 shows a schematic cross sectional view of a hybrid piston-PDE, indicated as engine 10, in a representative embodiment of the invention for generating both shaft power and thrust power. In FIG. 1 it is seen that engine 10 comprises one or more cylinders 11 communicating with a PDE, where one detonation tube 13 connects with each cylinder 11. Each detonation tube 13 has an internal channel 14 extending the length of the tube. The piston engine and the PDE are operatively connected such that each cylinder 11 functionally becomes part of the internal channel 14 of the respective detonation tube connected thereto. Cylinder 11 effectively becomes the closed end of internal channel 14 disposed upstream of detonation tube 13. The downstream end 15 of internal channel 14 is open to ambient and serves as an exhaust. It may be preferable to connect detonation tube 13 to the piston engine such that channel 14 of each detonation tube 13 is perpendicular to a cylinder 11.

Figure 2:
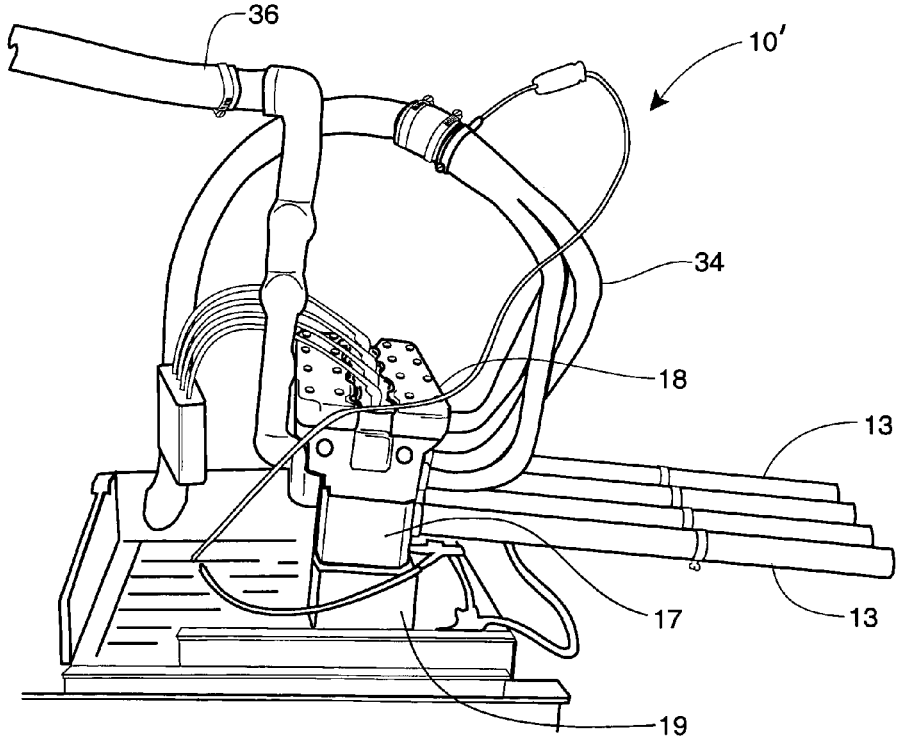
FIG. 2 shows an assembly of a hybrid piston-PDE built and operated in demonstration of the invention.

FIG. 2 shows an assembly of a representative hybrid piston-PDE engine 10' built and operated in demonstration of the invention. The engine illustrated in FIG. 2 was constructed using a modified stock four-cylinder four-stroke engine, although a two-stroke engine may be used. Any of a number of cylinder configurations may be used, such as inline configuration, a V configuration, or two horizontally opposed rows. Spacer block 17 was placed between head 18 and block 19 of engine 10' to allow for the creation of four airflow passages, channels 14, for four detonation tubes 13. FIG. 3 is a view in perspective of spacer block 17 separate from the engine assembly. Spacer block 17 effectively lengthens cylinder 11 and allows the detonation tubes 13, one communicating to each cylinder 11, to be placed perpendicular to the travel of each piston 20.

An electric motor was used as an external power supply to start the engine. A chain was used to connect the electric motor to the output sprocket of the transmission. With the transmission in gear and the clutch engaged, power from the electric motor was transmitted to the crankshaft and from the crankshaft (21 of FIG. 1) to the camshaft (23 of FIG. 1) via a timing chain. With the engine rotating, the air and fuel flows were adjusted to match the volume of detonation tubes 13 and engine frequency. A spark from stock ignition system 25 to ignited the fuel air mixture. After several engine cycles, the clutch was disengaged separating the electric motor from the hybrid engine.

Figure 4:
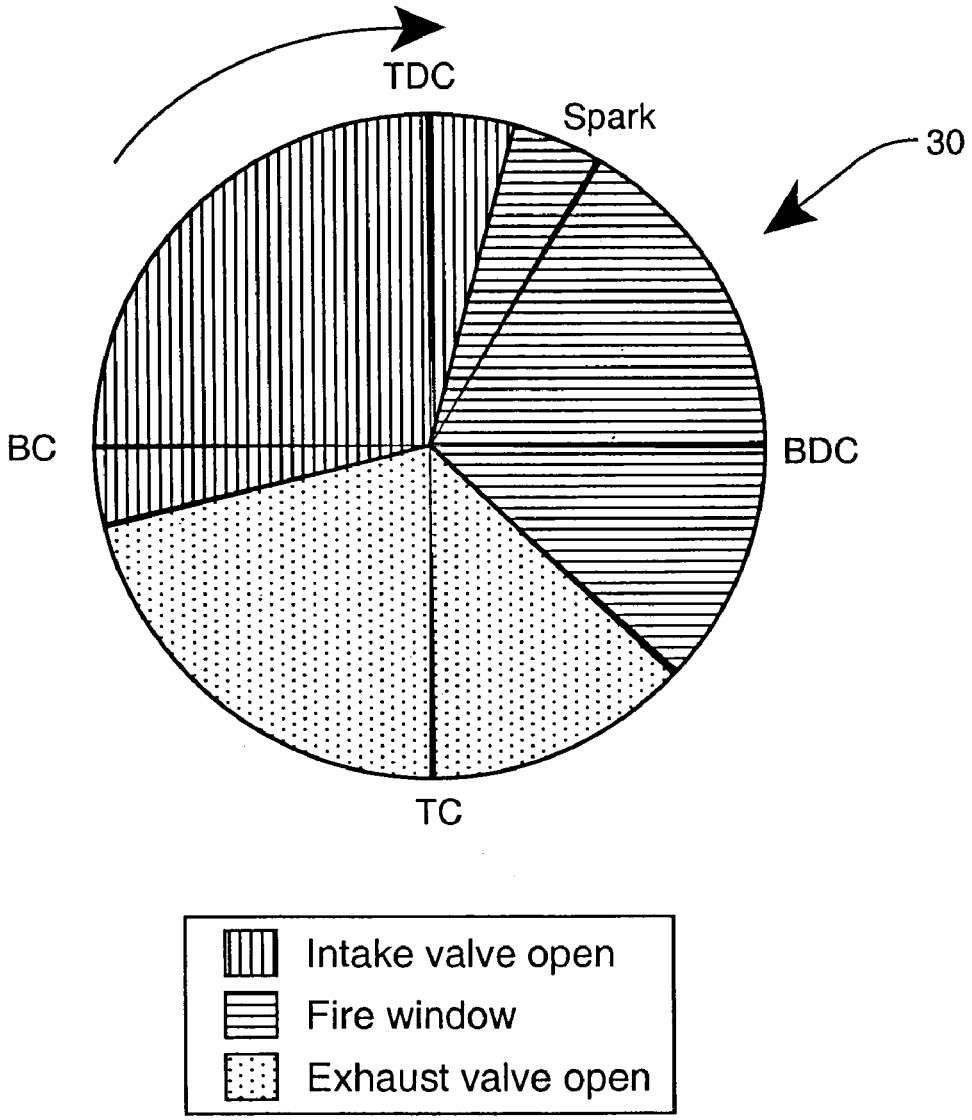
FIG. 4 is a diagram of valve and spark timing relative to piston position in the engine of FIGS. 1 and 2 built in demonstration of the invention.

With spacer block 17 installed, the cam-chain and the oil supply and return lines to the head had to be extended. The spark and valve timing were altered from that of the stock engine. To maximize the power output of the hybrid engine the spark timing was adjusted so that the pressure from the detonation cycle occurred while the piston was traveling downward at maximum velocity. The valve and spark timing relative to the piston position is depicted in FIG. 4. Starting at the top of diagram 30 in FIG. 4 and moving clock wise, the intake valve closes about 15° after a piston 20 reaches top dead center (TDC). A stoichiometric mixture of hydrogen and air flows through the intake valve 31 (FIG. 1) when it opens. At about 30° on the cam, the spark plug was fired. The stock ignition system was used to initiate deflagration of the fuel air mixture. The timing of the spark was altered by adjusting the circumferential position of the Hall effect sensor around crankshaft 21. A Shelkin shocking spiral was used to transmission the deflagration to a detonation. For several milliseconds after the detonation wave exits the detonation tube 13, the pressure on piston 20 was above atmospheric. The spark timing was chosen to maximize the PdV work extracted by piston 20.

By the time the piston reaches bottom dead center (BDC), the pressure and the remainder of the possible fire window was not used. At about 135° on the cam, exhaust valve 33 opens and purge air 34 (FIG. 2) flows into cylinder 11 and down detonation tube 13 to separate the hot exhaust product from the next air fuel charge. Intake valve 31 opens at about 255° on the cam after TDC and a premixed charge of air and fuel filled cylinder 11 and detonation tube 13 and the cycle repeated. An air compressor (not shown) was used to supply air to the hybrid engine.

In this particular embodiment the thrust of the hybrid engine was lower than that the thrust from a PDE alone. The volume of cylinder 11 was approximately 10% of detonation tube 13. Removing all of the work from the higher-pressure gas prior to blow-down would ideally decrease pressure in detonation tube 13 by about 14.4%. However, in this particular embodiment the thrust produced by the hybrid engine was about ½ that of the thrust on a PDE alone. The pressure of the shock wave traveling down detonation tube 13 was 2.6 times greater for the PDE alone. The blow-down pressure for the PDE was about 20% higher than that of the hybrid engine. In the hybrid piston-PDE the DDT was occurring as piston 20 was receding creating an expansion wave and hindering the DDT process, accounting for the difference in thrust between the two engines.

A deflagration to detonation transition (DDT) is used to achieve detonation. A Shelkin shocking spiral or other suitable detonation initiation mechanism can be used to transmission the deflagration to a detonation. Piston 20 is located in the deflagration region of the DDT, such that it is subject to the gradual rise of P3 detonation pressures, as opposed to the von Neumann shock.

Preferably, the valving arrangement 31, 33 for the piston engine will have ample valve area, such as a rotary, piccolo or slide valve. Traditional piston engines act as air pumps, since the motion of the piston in concert with the valve train can be used to draw in fresh air and expel exhaust products. However, in the present invention the piston cannot be used to pump air since the down stream end 15 of detonation tube 13 and hence of cylinder 11 are always open to the atmosphere. Thus, a means 36 (FIG. 2) to supply air to the engine is necessary.

The hybrid engine has critical starting frequency, therefore an external power source in necessary to achieve the critical frequency. Above this frequency the engine will self-actuate and produce excess power. Below this frequency, the power produced is less than that required to self-actuate and the engine decelerates and stops rotating. The critical frequency for this hybrid engine is a result of the different time constants for the piston movement and the detonation tube blow down event. The time constant for the piston engine is defined as, $$t_p=2/f_{crank} \tag{1}$$

where $f_{crank}$ is the frequency of the crankshaft 23 and the time constant for the blow down event is the time required for the pressure in the detonation tube 13 to decrease to ⅓ of the gage pressure behind the detonation wave. As a result, the pressure in cylinder 11 closed-end region reduces to be lower than that of the surrounding atmosphere. This low-pressure condition inside detonation tube 13 is detrimental to propulsion. Thus, a means to purge detonation tube 13 is preferred. One way to accomplish purging would be to insert inert gas through the exhaust valve before the start of another detonation cycle.

The rotational frequency of the hybrid engine can be governed in several ways. First, by reducing the fill fraction of detonation tube 13, which can be accomplished by altering the pressure in the intake manifold upstream of valves 31, 33. Second, the equivalence ratio of the charge can be used to govern the hybrid engine. Third, spark plug 25 timing can be altered. There is an optimum-spark-timing for extracting power from detonation. By moving the spark off this optimum timing, less work is extracted from the detonation, which will control the rotational speed off the engine, and generate more thrust. Finally, detonation tube 13 can be used to govern the rotational speed of the engine. Detonation tube length, instillation of a nozzle on the downstream end 15 of detonation tube 13 and the geometry of that nozzle can affect the blow-down time, which affects the amount of work and thrust that is extracted by the pistons 20.

For most of the conditions tested the time constant of the detonation-tube-blow-down was smaller than that of piston 20 movement. If the time constants were too different, the blow down process would occur while piston 20 would effectively be stationary; therefore little or no PdV work would be extracted from the detonation pressure. By increasing the starting frequency, and lengthening detonation tube 13, the time constants of the piston movement and blow down process were similar enough that the work extracted by piston 20 exceeded the requirement to self-actuate.

Referring now to FIG. 5, shown therein is a graphical representation of engine timing and pressure during a cycle at two different operating frequencies, showing that at higher frequencies, the blow down process occurs over a larger portion of the movement of piston 20. The critical frequency can be calculated by a number of methods. First, the critical frequency can be calculated by estimating the power required for self-actuation and equating that with the PdV work extracted as a function of frequency. The power required for self-actuation included the power required for the system friction and the power required to open and close valves 31, 33.

Figure 6:
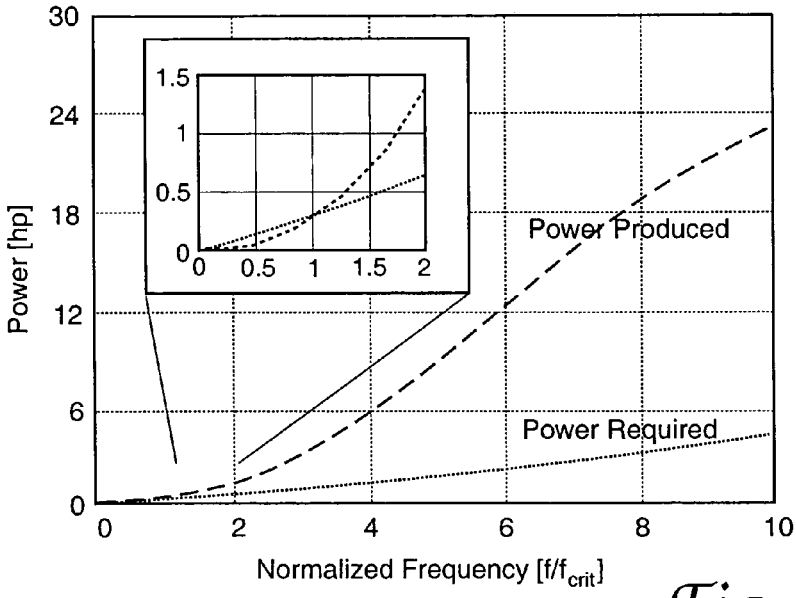
FIG. 6 shows a plot of the power required and the power produced as a function of the normalized frequency in the hybrid engine of the invention.

FIG. 6 shows a plot of the power required and the power produced as a function of the normalized frequency in the hybrid engine of the invention. Another way to calculate critical frequency would be to test the required power on a dynamometer.

Figure 7A:
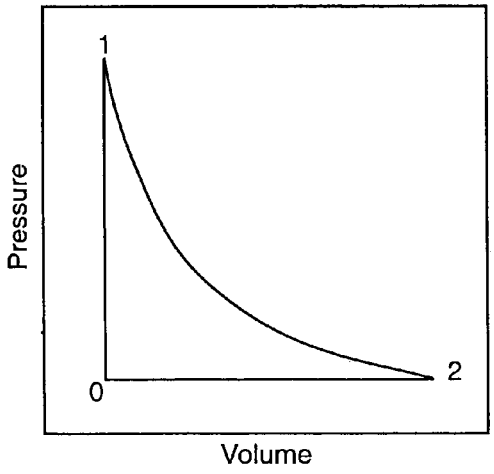
FIGS. 7*a* and 7*b* graphically illustrate that the ideal thermodynamic piston-PDE cycle consists of a constant volume heat addition process followed by an isentropic expansion process.
Figure 7B:
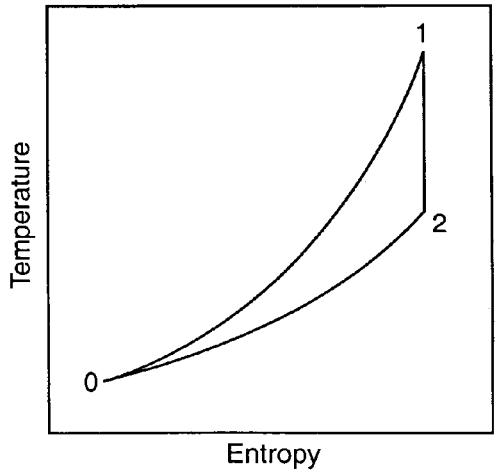

The ideal thermodynamic piston-PDE cycle consists of a constant volume heat addition process followed by an isentropic expansion process. In FIG. 7*a* the ideal T-s diagram for the hybrid piston-PDE is given and in FIG. 7*b* the ideal P-v diagram is given. This cycle is very similar to the Air-Standard Otto cycle except there is no isentropic compression of the working fluid before the constant volume heat addition.

The thermal efficiency 77 of the hybrid piston-PDE is given by:

$$\eta = 1 - \gamma\left[\frac{\left(\frac{T_1}{T_0}\right)^{\frac{1}{\gamma}} - 1}{\left(\frac{T_1}{T_0}\right) - 1}\right] \tag{2}$$

Where $\gamma$ is the ratio of specific heats and T is temperature.

The invention therefore provides a pulsed detonation engine system structure for producing shaft power from a PDE. It is understood that modifications to the invention may be made as might occur to one with skill in the field of the invention within the scope of the appended claims. All embodiments contemplated hereunder that achieve the objects of the invention have therefore not been shown in complete detail. Other embodiments may be developed without departing from the spirit of the invention or from the scope of the appended claims.

I claim:

1. A hybrid piston engine-pulsed detonation engine structure for obtaining shaft power from a pulsed detonation engine, comprising:

a pulsed detonation engine;

a piston engine operatively connected to said pulsed detonation engine, said piston engine having one or more cylinders; and a detonation tube interconnecting each said cylinder with said pulsed detonation engine, each said tube comprising means through which each said cylinder of said piston engine communicates with said pulsed detonation engine.

2. The hybrid engine structure of claim 1 wherein each said detonation tube is disposed perpendicular to the respective cylinder to which it is connected.

3. The hybrid engine of claim 2 wherein said piston engine comprises at least four cylinders.

4. A hybrid engine comprising:

a piston engine having a head, an engine block, and at least one cylinder positioned within the engine block;

a spacer block sandwiched between the head and the engine block, the spacer block adapted to longitudinally increase the volume of the cylinder; and a detonation tube having a proximal end and a distal end, the proximal end of the detonation tube being attached to the spacer block, the detonation tube being in operational communication with the cylinder whereby a detonation in the detonation tube communicates energy towards the distal end of the detonation tube and into the cylinder.

5. The hybrid engine of claim 1 wherein the detonation tube is perpendicularly connected to the cylinder.

6. The hybrid engine of claim 1 wherein the piston engine comprises at least four cylinders.

7. The hybrid engine of claim 1 wherein the piston engine further comprises an ignition system attached to the head.

8. The hybrid engine of claim 1 wherein the piston engine further comprises an intake valve attached to the head.

9. The hybrid engine of claim 1 wherein the piston engine further comprises an exhaust valve attached to the head.

10. The hybrid engine of claim 1 wherein the piston engine further comprises a piston positioned within the cylinder.

11. The hybrid engine of claim 10 wherein the piston engine further comprises a crankshaft operationally attached to the piston.

12. The hybrid engine of claim 11 wherein the piston engine further comprises a camshaft in operational communication with the crankshaft.

13. A method for generating shaft power comprising the steps of:

providing a hybrid engine having a piston engine with a head, a spark plug, an intake valve, and an exhaust valve attached to the head, an engine block, at least one cylinder positioned within the engine block, a piston positioned within the cylinder, a cam in operational communication with the piston, a spacer block sandwiched between the head and the engine block, the spacer block adapted to longitudinally increase the volume of the cylinder, and a detonation tube having a proximal end and a distal end, the proximal end of the detonation tube being attached to the spacer block, the detonation tube being in operational communication with the cylinder;

starting the hybrid engine; and setting the spark timing so that energy from the detonation cycle occurs while the piston is traveling away from the head at the maximum velocity.

14. The method of claim 13 further comprising the step of providing an electric motor to provide external power to start the hybrid engine.

15. The method of claim 13 further comprising the step of providing a stoichiometric mixture of hydrogen and air through the intake valve.

16. The method of claim 13 further comprising the step of using an air compressor to supply air to the hybrid engine.

17. The method of claim 13 further comprising the step of closing the intake valve when the cam rotates about fifteen degrees from the top dead center of the piston cycle.

18. The method of claim 13 further comprising the step of firing the spark plug when the cam rotates about thirty degrees from the top dead center of the piston cycle.

19. The method of claim 13 further comprising the step of opening the exhaust valve when the cam rotates about one hundred thirty degrees from the top dead center of the piston cycle.

20. The method of claim 13 further comprising the step of opening the intake valve when the cam rotates about two hundred fifty-five degrees from the top dead center of the piston cycle.

* * * * *